United States Patent [19]

Crouse et al.

[11] Patent Number: 4,806,274

[45] Date of Patent: Feb. 21, 1989

[54] SCENTED CLEANER FOR GUNS

[75] Inventors: Robert H. Crouse, 264 Mt. Hope Rd., #9, Mansfield Center, Conn. 06250; William J. Ziese, Jr., Sharon Springs, N.Y.

[73] Assignee: Robert H. Crouse, Storrs, Conn.

[21] Appl. No.: 220,906

[22] Filed: Jul. 19, 1988

Related U.S. Application Data

[63] Continuation of Ser. No. 946,897, Dec. 29, 1986, abandoned.

[51] Int. Cl.[4] ..... C11D 3/50

[52] U.S. Cl. ..... 252/548; 252/544; 252/155; 252/DIG. 14; 252/174.11

[58] Field of Search ..... 252/174.11, 544; 134/8, 134/22.14, 39

[56] References Cited

U.S. PATENT DOCUMENTS

| | | | |
|---|---|---|---|
| 1,535,124 | 4/1925 | Laughlin | 134/2 |
| 1,952,008 | 3/1934 | Bruson | 252/544 |
| 3,681,248 | 8/1972 | Gould et al. | 252/174.11 |
| 3,703,472 | 11/1972 | Shaw | 252/107 |
| 3,915,880 | 10/1975 | Sepulveda | 252/99 |
| 4,315,780 | 2/1982 | Rupp | 134/7 |

*Primary Examiner*—Prince E. Willis
*Assistant Examiner*—John F. McNally
*Attorney, Agent, or Firm*—Henderson & Sturm

[57] ABSTRACT

A scented gun cleaner composition comprising the combination of a primary cleaning component and a scent component selected from an aromatic live plant extract wherein the scent component is used to mask the odor of the primary cleaning component and other warning odors such as gun powder and solvents.

11 Claims, No Drawings

SCENTED CLEANER FOR GUNS

This is a continuation of co-pending application Ser. No. 946,897, filed on Dec. 29, 1986, now abandoned.

TECHNICAL FIELD

The present invention relates to cleaning compounds developed for use with outdoor sporting equipment.

BACKGROUND OF THE INVENTION

Cleaning compounds are well recognized in the prior art, in fact, the different types of cleaners are almost as diverse as the ways in which they are employed. Unfortunately, a common characteristic or trait of most cleaners is a strong and distinct odor or aroma.

While most cleaners are either employed in closed systems or in such relatively small amounts in open environments, as to not produce an overly offensive olfactory response in humans, it is well recognized that the senses are not as well developed in humans as they are in other animals and marine life.

It is further well recognized that both fish and game are very sensitive to foreign aromas, odors and the like; and, as a result, a body of prior art patents has been developed involving lures, attractants and masking compounds. Examples of some of the aforementioned prior art compounds may be seen by reference to U.S. Pat. Nos. 2,874,048; 3,666,669; 3,822,211 and 3,421,899.

In addition to the above cited prior art, there are numerous commercially available masking scents such as pine and cedar oils and skunk, fox and deer urine which are normally applied in the vicinity of a gun or bowhunter to mask the human odor from game animals.

While these particular scents may in some instances be applied directly to a hunter's clothes, boots or hat, they are rarely employed in that manner for both aesthetic and practical considerations and, the usual placement of these scents is in the vicinity of the hunter in a downwind direction.

It should also be noted that due to the expense and the materials employed in most modern shotguns, rifles and compound bows, it is both impractical, undesirable and in some instances actually harmful to apply these scent compositions to the surface of a weapon.

Some of the deleterious and impractical results of applying undiluted or ulaltered scent compositions directly to the surface of a weapon are the staining of wooden stocks and bow limbs, the penetration of the scent into the porous wood components, the rapid evaporation of liquid scent compositions on bare metal components, the promotion of rust on the metal components and, the pitting and etching of the metal components due to the acid content of the urine based scents.

Up until the development of the present invention, hunters had no other alternative than to use an odiferous cleaner to keep their weapon clean; and then while actually engaged in the act of hunting, employ a separate and distinct masking scent to counteract the telltale aroma produced by the cleaner.

BRIEF SUMMARY OF THE INVENTION

The present invention relates to a naturally scented cleaning composition for guns and the like, wherein the scent component of the composition has a base which is compatible and miscible with the primary cleaner component.

The end result of this combination of compatible components is a composition that will provide the requisite cleaning of a weapon, while at the same time producing a masking odor or scent that will counteract the distinctive cleaner odors and greatly reduce the probability that game animals will be "spooked" by the unfamiliar aroma normally associated with weapons.

BEST MODE FOR CARRYING OUT THE INVENTION

The present invention comprises a composition having primary cleaning component and a compatible scent component. Inasmuch as the composition has as its primary objective the cleaning of the components of a weapon or the like, the cleaning component for the purposes of this invention will comprise an alkanolamide of an unsaturated fatty acid such as is used in "Monamine CD-100", a diethanolamine linoleamide composition supplied by Mona Industries, 76 East 24th Street, Patterson, N.J. 07544.

The preferred scent component of the composition comprises a live plant extract such as pine oil, cedar oil, acorn oil or the like, wherein the extract is selected from aromatic woods indigenous to the geographic area wherein the composition is intended for use. Suitable naturally occuring oils are available from Pete Rickard, Inc., Crommie Road, Cobleskill, N.Y. 12043.

Pine oil and cedar oil are the most logical choices for the scent component of the composition, due to their inherent pungency and aroma, coupled with their widespread dispersion throughout the country, particularly in areas wherein game concentrations abound.

Other extracts which are contemplated for use in this composition are derived from acorns, corn and apples. However, it should be noted that these extracts are substantially less desirable due to the fact that these scents would only be effective in the vicinity of concentrations of these whole natural counterparts. This is due to the fact that a food scent, used in an area where that particular food is not normally grown, is as foreign to a deer or other game animal as the smell of gun oil, solvents or the like.

Inasmuch as the primary purpose of the present invention is to provide an improved cleaner for weapons, it became imperative to determine the ideal proportion of the cleaning component to the masking scent component, and also to insure that the respective components were miscibly compatible with one another.

EXAMPLE 1

Through trial and error it was discovered that the following minimum and maximum values produces a composition having good to excellent cleaning properties, as well as a pleasant natural smell.

TABLE 1

| Component | Weight Percent Range | Weight Percent Preferred | Function |
|---|---|---|---|
| Borates of mixed amines | 0.3%–10.0% | 1.0% | Corrosion inhibitor |
| Alkanolamide of an unsaturated fatty acid | 0.3%–20.0% | 5.0% | Cleaner, corrosion inhibitor, emulsifier |
| Naturally occurring powder of prehistoric origin | 0.3%–20.0% | 5.0% | Polishing agent |
| Synthetic water soluble lubricant | 0.3%–20.0% | 5.0% | Lubricant |
| Naturally occurring | 0.1%–20.0% | 2.5% | Natural |

TABLE 1-continued

| Component | Weight Percent Range | Preferred | Function |
|---|---|---|---|
| oil-distilled from its source | | | scent |
| Water | 10.0%–98.7% | 81.5% | Carrier |

EXAMPLE 2

The following specific formulation has been found to have excellent cleaning properties while successfully masking odors repugnant to game animals:

TABLE 2

| Component | Weight Percent | Function | Source |
|---|---|---|---|
| "Monacor BE" (Monoethanolamine borate and monoisopropanolamine borate) | 1.0% | Corrosion inhibitor | Mona Industries, Inc. 76 E 24 Street Patterson, New Jersey 07544 |
| "Monamine CD-100" (Diethanolamine Linoleamide) | 5.0% | Cleaner, corrosion inhibitor, emulsifier | Mona Industries, Inc. 76 E 24 Street Patterson, New Jersey 07544 |
| "Super Floss" (Diatomaceous earth) | 5.0% | Polishing agent | Johns-Manville P.O. Box 517 Toledo, Ohio 43693 |
| "Emery 2908" Synthetic Lubricant Base Stock CAS No.: 68551-94-0 (Polyethylene glycol-Azaleic acid diester) | 5.0% | Lubricant | Synthetic Lubricants Group Emery Chemicals 11501 Northlake Drive Cincinnati, Ohio 45245 |
| Cedar oil | 2.5% | Natural scent | Pete Rickard, Inc. Crommie Road Cobleskill, N.Y. 12043 |
| Water | 81.5% | Carrier | |

The cleaner of Example 2 provides superior cleaning of firearms while masking the warning odors deer and other game are conditioned to fear. The cleaner is useful for cleaning the bore and receiver of firearms and can also be safely used to clean the gun stock and gun barrel. The scent used is extracted from natural vegetation, including cedar and pine scents that have the natural smell of a growing tree.

Obviously, other combinations of cleaning components and scent components will produce equally suitable compositions if combined within the percentage parameters set forth herein, and this invention is not intended to be limited to the specific examples set forth above.

Having thereby described the subject matter of this invention, it should be obvious that many substitutions, modifications and variations of the invention are possible in light of the above teachings. It is therefore to be understood that the invention as taught and described herein is only to be limited to the extent of the breadth and scope of the appended claims.

We claim:

1. A scented cleaning composition for use with outdoor sporting equipment, comprising:

from about 0.3 to about 20.0 weight percent diethanolamine linoleamide;

from about 0.1 to about 20.0 weight percent of a scent components extracted from live plants normally found in areas where game animals abound; and from about 75.0 to about 94.9 weight percent of a carrier.

2. The compositions of claim 1 wherein said extract is derived from edible live plants normally consumed by game animals.

3. The composition of claim 1 further including:

from about 03. to about 10.0 weight percent of a corrosion inhibitor.

4. The composition of claim 1 further including:

from about 0.3 to about 20.0 weight percent of a polishing agent.

5. The composition of claim 1 further including:

from about 0.3 to about 20.0 weight percent of a lubricant.

6. The composition of claim 1 wherein said extract is cedar oil.

7. The composition of claim 1 wherein said extract is pine oil.

8. The composition of claim 1 wherein said extract is acorn oil.

9. The composition of claim 2 wherein said extract is derived from corn.

10. The composition of claim 2 wherein said extract is derived from apples.

11. A scented cleaning composition for use with outdoor sporting equipment consisting of:

1.0 weight percent of a monoethanolamine borate-monoisopropanolamine borate mixture;

5.0 weight percent diethanolamine linoleamide;

5.0 weight percent diatomaceous earth;

5.0 weight percent polyethylene glycol-azaleic acid diester;

2.5 weight percent cedar oil; and 81.5 weight percent water.

* * * * *